US009466312B2

(12) United States Patent
Cho et al.

(10) Patent No.: US 9,466,312 B2
(45) Date of Patent: Oct. 11, 2016

(54) METHOD FOR SEPARATING AUDIO SOURCES AND AUDIO SYSTEM USING THE SAME

(71) Applicant: KOREA ELECTRONICS TECHNOLOGY INSTITUTE, Seongnam-si, Gyeonggi-do (KR)

(72) Inventors: Choong Sang Cho, Seongnam-si (KR); Je Woo Kim, Seongnam-si (KR); Byeong Ho Choi, Yongin-si (KR); Hwa Seon Shin, Yongin-si (KR)

(73) Assignee: KOREA ELECTRONICS TECHNOLOGY INSTITUTE, Seongnam-si, Gyeonggi-do (KR)

( * ) Notice: Subject to any disclaimer, the term of this patent is extended or adjusted under 35 U.S.C. 154(b) by 16 days.

(21) Appl. No.: 14/553,188

(22) Filed: Nov. 25, 2014

(65) Prior Publication Data

US 2015/0365766 A1 Dec. 17, 2015

(30) Foreign Application Priority Data

Jun. 11, 2014 (KR) ..... 10-2014-0070876

(51) Int. Cl.
*H04R 5/04* (2006.01)
*G10L 21/0272* (2013.01)

(52) U.S. Cl.
CPC ..... *G10L 21/0272* (2013.01)

(58) Field of Classification Search
None
See application file for complete search history.

(56) References Cited

U.S. PATENT DOCUMENTS 6,628,787 B1 * 9/2003 McGrath ..... H04S 3/02 381/17
8,218,775 B2 * 7/2012 Norvell ..... G10L 19/24 381/23
2008/0140426 A1 * 6/2008 Kim ..... G10L 19/008 704/500
2011/0040556 A1 * 2/2011 Moon ..... G10L 19/008 704/205
2011/0046964 A1 * 2/2011 Moon ..... G10L 19/008 704/500
2011/0103592 A1 * 5/2011 Kim ..... G10L 19/008 381/22
2011/0194709 A1 * 8/2011 Ozerov ..... G10L 21/0272 381/119
2011/0311060 A1 * 12/2011 Kim ..... G10L 19/008 381/17
2014/0079248 A1 * 3/2014 Short ..... G10L 21/0272 381/119

FOREIGN PATENT DOCUMENTS

KR 1020070107615 A 11/2007
KR 1020130086486 A 8/2013
WO WO 2015150066 A1 * 10/2015 ..... G10H 1/0091

OTHER PUBLICATIONS

English machine translation of Korean Office Action mailed Jun. 12, 2015 for corresponding Korean Application No. 10-2014-0070876.*
Korean Office Action mailed Jun. 12, 2015 for corresponding Korean Application No. 10-2014-0070876, citing the above references.

* cited by examiner

*Primary Examiner* — Brenda Bernardi
(74) *Attorney, Agent, or Firm* — Hauptman Ham, LLP

(57) ABSTRACT

A method for separating audio sources and an audio system using the same are provided. The method introduces the concept of a residual signal to separate a mixed audio signal into audio sources, and separates an audio signal corresponding to at least two of the audio sources as a residual signal and processes the audio signal separately. Therefore, audio separation performance can be improved. In addition, the method re-separates a separated residual signal and adds the separated residual signals to corresponding audio sources. Therefore, audio sources can be separated more safely.

6 Claims, 5 Drawing Sheets

METHOD FOR SEPARATING AUDIO SOURCES AND AUDIO SYSTEM USING THE SAME

PRIORITY

The present application claims the benefit under 35 U.S.C. §119(a) to a Korean patent application filed in the Korean Intellectual Property Office on Jun. 11, 2014, and assigned Serial No. 10-2014-0070876, the entire disclosure of which is hereby incorporated by reference.

TECHNICAL FIELD OF THE INVENTION

The present invention relates generally to a method for separating audio sources, and more particularly, to a method for separating audio sources from a mixed audio signal, and an audio system using the same.

BACKGROUND OF THE INVENTION

FIG. 1 illustrates a view showing the concept of a related-art method for separating audio sources. In FIG. 1, $s_1$, $s_2$, and $s_3$ are three (3) different audio sources, and x is a mixed audio signal, That is, x is a mix signal of $s_1$, $s_2$, and $s_3$.

As shown in FIG. 1, there is no overlap among the audio sources $s_1$, $s_2$, and $s_3$. That is, the audio sources $s_1$, $s_2$, and $s_3$ are independent of one another.

In this circumstance, there is no problem in separating the audio signal x into the audio sources $s_1$, $s_2$, and $s_3$. This is because an audio component constituting the audio signal x can be matched with one of the audio sources $s_1$, $s_2$, and $s_3$.

However, the audio signal x and the audio sources $s_1$, $s_2$, and $s_3$ shown in FIG. 1 are the ideal or very special case. In practice, the audio signal x and the audio sources $s_1$, $s_2$, and $s_3$ are in the state shown in FIG. 2.

That is, the audio sources $s_1$, $s_2$, and $s_3$ are not completely independent of one another. That is, there is an overlap among the audio sources $s_1$, $s_2$, and $s_3$. In this circumstance, there is no problem in mixing the audio sources $s_1$, $s_2$, and $s_3$ into the single audio signal x.

However, a problem arises when the mixed audio signal x is separated into the audio sources $s_1$, $s_2$, and $s_3$. This is because an audio component corresponding to the overlapping area of the audio sources $s_1$, $s_2$, and $s_3$ cannot be matched with one of the audio sources $s_1$, $s_2$, and $s_3$.

Due to this problem, an audio source separation algorithm processes the audio signal x and the audio sources $s_1$, $s_2$, and $s_3$ on the assumption that the audio signal x and the audio sources $s_1$, $s_2$, and $s_3$ are in the state shown in FIG. 1 even if the audio signal x and the audio sources $s_1$, $s_2$, and $s_3$ are actually in the state shown in FIG. 2.

Since the audio sources are separated without considering the real state of the audio signal and the audio sources, excellent audio source separation performance would not be guaranteed and it is.

SUMMARY OF THE INVENTION

To address the above-discussed deficiencies of the prior art, it is a primary aspect of the present invention to provide a method for separating audio sources, which is based on a method for separating an audio signal corresponding to at least two of audio sources as a residual signal in separating audio sources from a mixed audio signal, and an audio system using the same.

According to one aspect of the present invention, a method for separating audio sources includes: receiving a mixed audio signal; and a first separation operation of separating the input mixed audio signal into a plurality of audio sources and a first residual signal.

The first residual signal may be an audio signal which is common to at least two of the plurality of audio sources.

The method may further include: a second separation operation of separating the residual signal separated by the first separation operation into residual signals corresponding to the plurality of audio sources and a second residual signal; and adding the residual signals to the audio sources, respectively.

The first separation operation and the second separation operation may be performed by using a Nonnegative Matrix Factorization-Expectation Maximization (NMF-EM) method, and the second separation operation may use parameters which are determined based on initial parameters used in the first separation operation and parameters updated by the first separation operation.

The second separation operation may use parameters which are obtained by giving weightings to the determined parameters.

The weighting may be determined based on an absolute power average of the mixed audio signal and an absolute power average of the first residual signal.

According to another aspect of the present invention, an audio system includes: an input unit configured to receive a mixed audio signal; and a separation unit configured to separate the input mixed audio signal into a plurality of audio sources and a first residual signal.

As described above, according to exemplary embodiments of the present invention, the concept of a residual signal is introduced to separate a mixed audio signal into audio sources, and an audio signal corresponding to at least two of the audio sources is separated as a residual signal. Therefore, audio separation performance can be improved.

In addition, according to exemplary embodiments of the present invention, a separated residual signal may be re-separated and separated residual signals may be added to corresponding audio sources. Therefore, audio sources can be separated more completely.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION OF THE INVENTION

Figure 1:
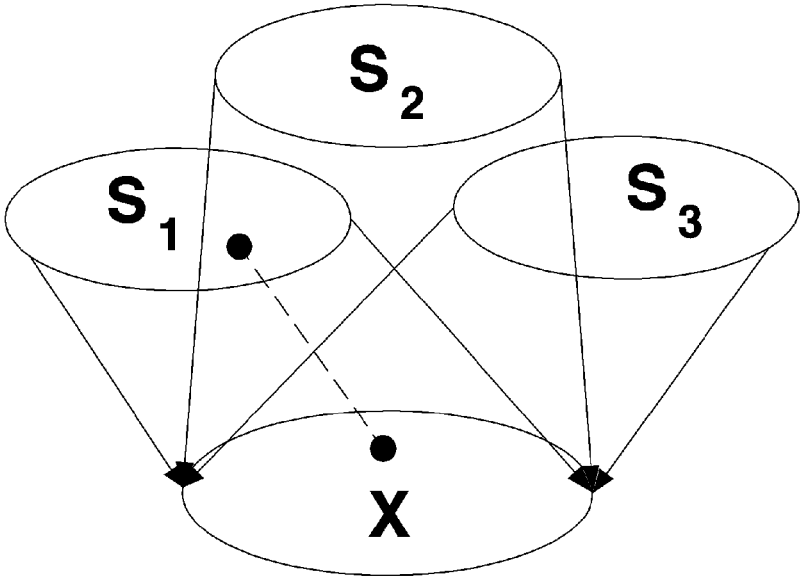
FIG. 1 (Related Art)
FIG. 1 is a view showing the concept of a related-art method for separating audio sources.
Figure 2:
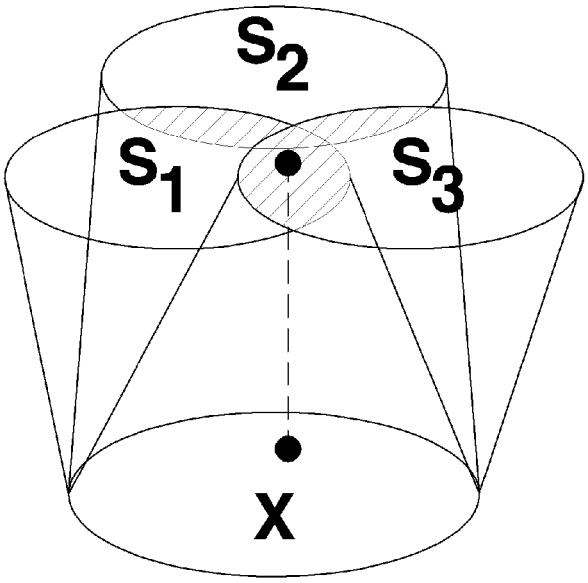
FIG. 2 (Related Art)
FIG. 2 is a view showing a relationship between a real audio signal and audio sources.

Reference will now be made in detail to the embodiment of the present general inventive concept, examples of which are illustrated in the accompanying drawings, wherein like reference numerals refer to the like elements throughout.

The embodiment is described below in order to explain the present general inventive concept by referring to the drawings.

Figure 3:
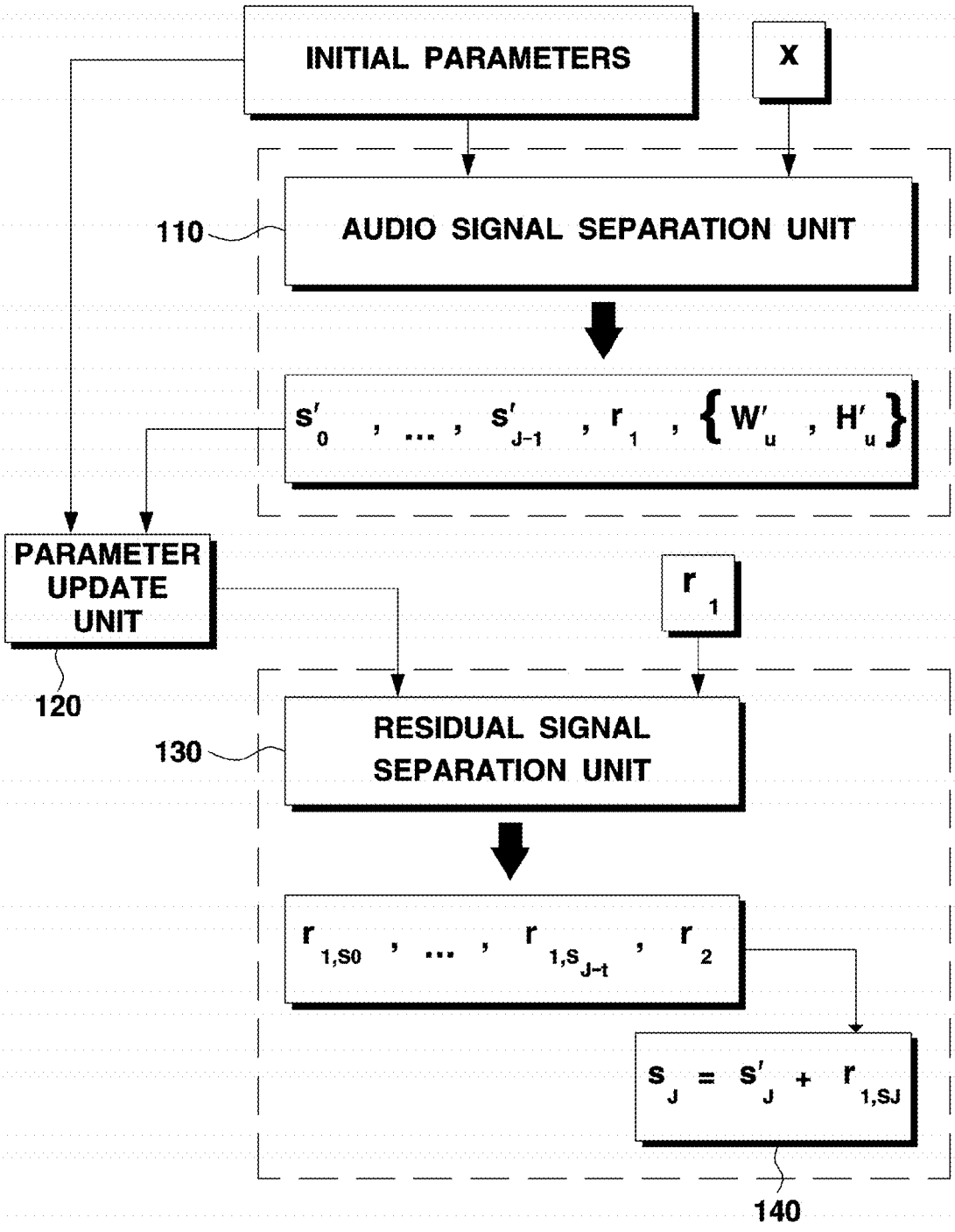
FIG. 3 is a block diagram of an audio system according to an exemplary embodiment of the present invention.
Figure 4:
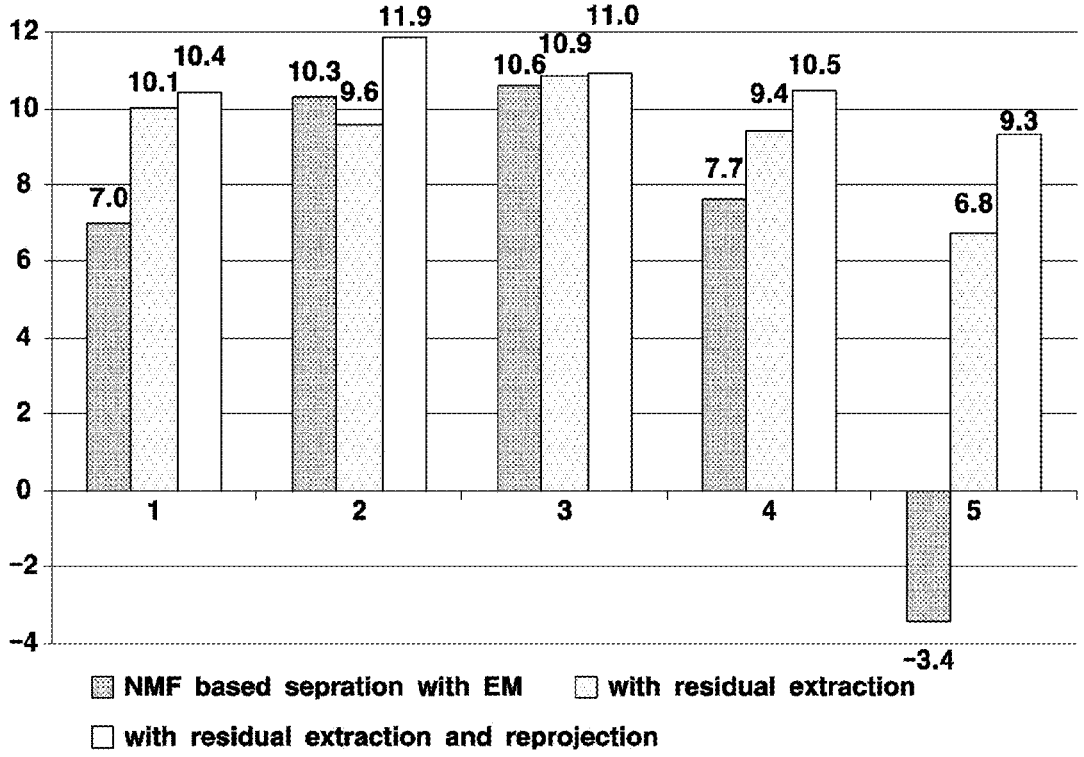
FIGS. 4 to 7 are graphs showing results of evaluating audio separation performance.
Figure 5:
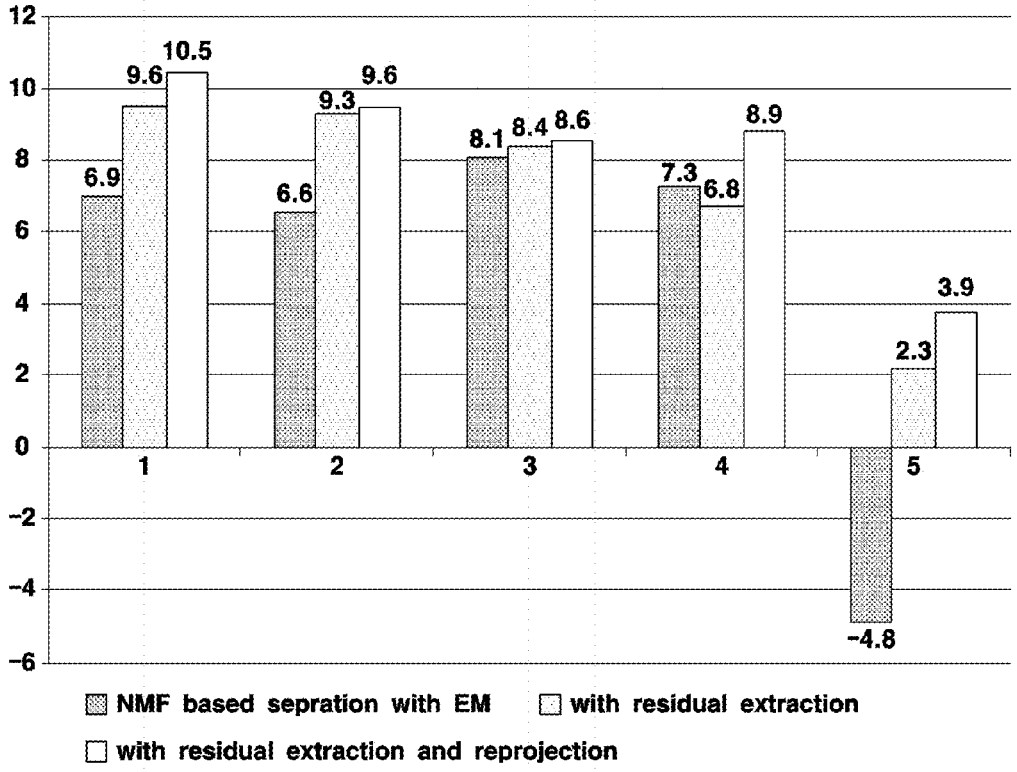
Figure 6:
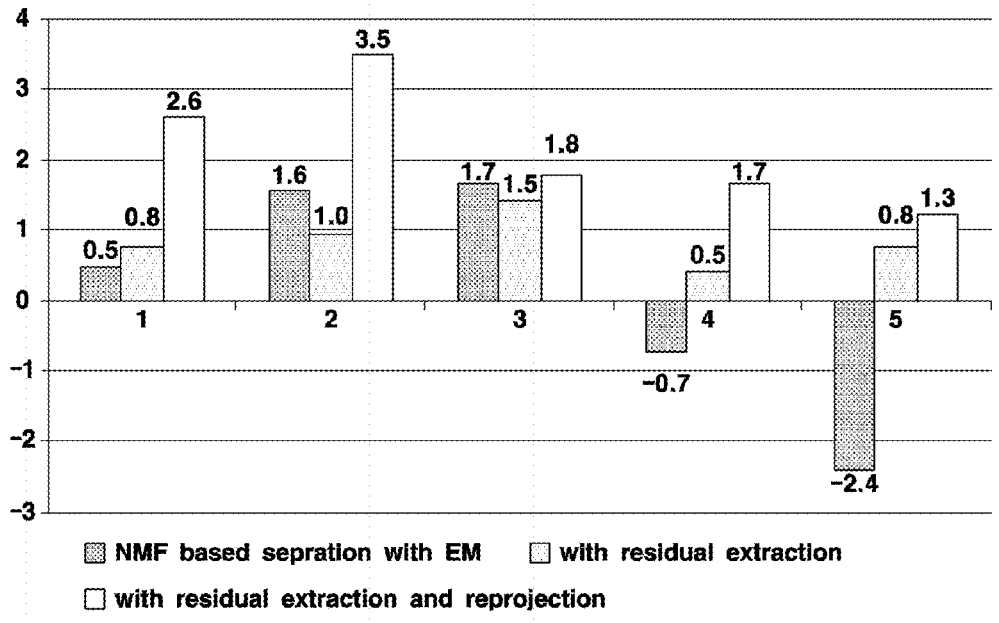
Figure 7:
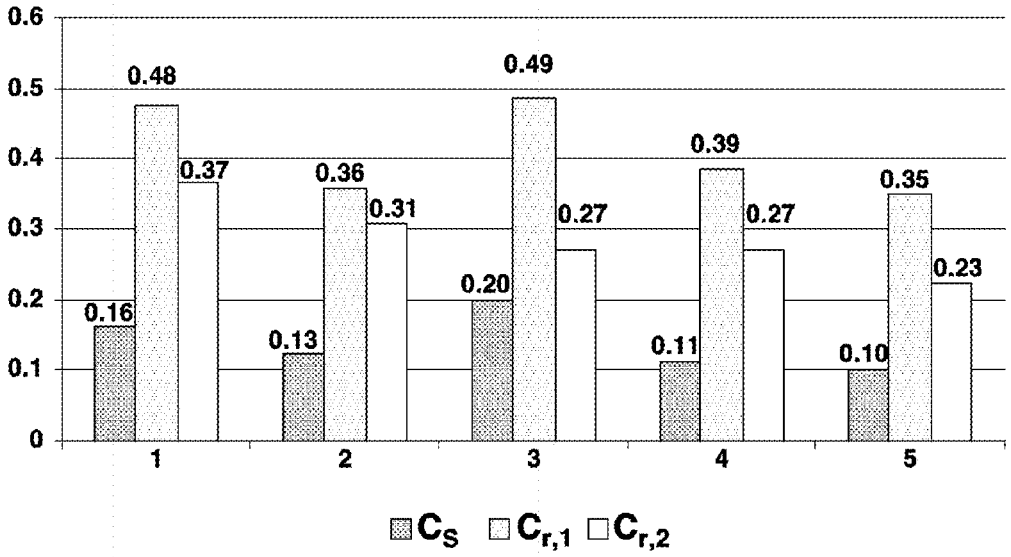

FIG. 3 is a block diagram of an audio system according to an exemplary embodiment of the present invention. The audio system according to an exemplary embodiment of the present invention is a system for separating an audio signal into audio sources.

The audio system performing the above-mentioned function includes an audio signal separation unit 110, a parameter update unit 120, a residual signal separation unit 130, and an audio source combination unit 140 as shown in FIG. 3.

In an exemplary embodiment, it is assumed that an audio signal x is a signal in which J number of audio sources (objects) $s_0, \ldots, s_{J-1}$ are mixed.

The audio signal separation unit 110 separates the input audio signal x into a plurality of audio sources $s'_0, \ldots, s'_{J-1}$ and a residual signal $r_1$. The residual signal $r_1$ corresponds to an audio signal which is common to at least two of the audio sources $s_0, \ldots, s_{J-1}$ (overlapping area).

Since the residual signal $r_1$ is separated from the audio signal x, the audio sources $s'_0, \ldots, s'_{J-1}$ separated from the audio signal x by the audio signal separation unit 110 are different from the original audio sources $s_0, \ldots, s_{J-1}$ which are the base for mixing the audio signal x.

The audio signal separation unit 110 uses a Nonnegative Matrix Factorization-Expectation Maximization (NMF-EM) method to separate the audio signal x.

The NMF-EM method is a well-known audio separation method and thus a detailed description thereof is omitted here.

In the related-art method using the NMF-EM method to separate the audio signal, updated parameters $\{W_u'H_u'\}$ are generated from initial parameters $\{W'H'\}$ regarding the audio sources, and audio sources are determined according to the updated parameters $\{W_u'H_u'\}$.

However, in the exemplary embodiment of the present invention, since the residual signal $r_1$ is separated from the audio signal in addition to the audio sources, it should be noted that the initial parameters $\{W'H'\}$ and the updated parameters $\{W_u'H_u'\}$ further include a parameter regarding the residual signal $r_1$ in addition to the parameters regarding the audio sources.

The residual signal separation unit 130 re-separates the residual signal $r_1$ separated by the audio signal separation unit 110. Specifically, the residual signal separation unit 130 separates the residual signal $r_1$ into residual signals $r_{1,s0}, \ldots, r_{1,sJ-1}$ regarding the audio sources and a residual signal $r_2$.

The residual signal $r_2$ is a signal that cannot be included in the residual signals $r_{1,s0}, \ldots, r_{1,sJ-1}$ regarding the audio sources. Conceptually, the residual signal $r_2$ may be interpreted as the residual signal $r_1$ which is common to the at least two of the audio sources $s_0, \ldots, s_{J-1}$ (overlapping area).

The residual signal separation unit 130 separates the residual signal $r_1$ by using the NMF-EM method. However, initial parameters $\{W_n'H_n'\}$ used in the NMF-EM method are calculated by the parameter update unit 120 according to following Equation 1:

$$\{W'_nW'_n\}=w_2\times[w_1\{W'H'\}+(1-w_1)\{W'_uH'_u\}] \qquad \text{Equation 1}$$

where $\{W'H'\}$ indicates initial parameters which are used by the audio signal separation unit 110 to separate the audio signal x, and $\{W'_uH'_u\}$ indicate parameters which are updated during the audio separation process of the audio signal separation unit 110.

Parameters used to separate the residual signal $r_1$ are obtained based on a sum of weightings given to the initial parameters used to separate the audio signal x and weightings given to the updated parameters which are generated as a result of the separating.

The weighting $w_1$ is to determine weights of the initial parameters $\{W'H'\}$ and the updated parameters $\{W'_uH'_u\}$ and satisfies $0 \le w_1 \le 1$. The weighting $w_2$ is to determine weights of the initial parameters $\{W'H'\}$ and the updated parameters $\{W'_uH'_u\}$ and satisfies $0 \le w_2 \le 1$.

The weighting $w_2$ is determined based on a ratio between an absolute power average of the audio signal x and an absolute power average of the residual signal $r_1$, and is expressed by following Equation 2:

$$w_2 = \frac{\frac{1}{F\times N}\sum_{f,n}|X_{f,n}|}{\frac{1}{F\times N}\sum_{f,n}|R_{1_{f,n}}|} \qquad \text{Equation 2}$$

The audio source combination unit 140 generates final audio sources by adding the residual signals $r_{1,s0}, \ldots, r_{1,sJ-1}$ regarding the audio sources separated by the residual signal separation unit 130 to the audio sources $s'_0, \ldots, s'_{J-1}$ separated by the audio signal separation unit 110.

The residual signal $r_2$ separated by the residual signal separation unit 130 may be discarded or may be re-separated. Specifically, the audio source combination unit 140 applies the residual signal $r_2$ to the residual signal separation unit 130 such that the residual signal $r_2$ is separated by the residual signal separation unit 130 like the residual signal $r_1$.

In this case, the audio source combination unit 140 adds residual signals $r_{2,s0}, \ldots, r_{2,sJ-1}$ regarding the audio sources separated from the residual signal $r_2$ to the final audio sources. In addition, a residual signal $r_3$ is separated from the residual signal $r_2$ by the residual signal separation unit 130.

Thereafter, it is possible to re-separate the residual signal $r_3$. It is determined whether to re-separate the residual signal based on the residual signal and parameters of the audio sources.

In the exemplary embodiment described up to now, the concept of a residual signal has been introduced and the method for separating audio sources from a mixed audio signal by separating an audio signal corresponding to at least two of the audio sources as a residual signal has been described.

The method for separating audio sources described above can be applied to a monitoring system and may be used to extract only a specific audio source (e.g., a voice) from an audio signal or remove a specific audio source (e.g., a sound of a wind, a vehicle horn sound). Furthermore, this method can be applied to give an audio effect for each audio source or create contents.

FIGS. 4 to 7 illustrate results of evaluating audio separation performance. As shown in FIGS. 4 to 7, the audio source separation performance achieved by using the residual signal is better than the performance that does not use the residual signal. In addition, the performance can be enhanced when the residual signal separation method is applied.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A method for separating audio sources, the method comprising:

receiving a mixed audio signal;

a first separation operation of separating the input mixed audio signal into a plurality of audio sources and a first residual signal;

a second separation operation of separating the first residual signal separated by the first separation operation into residual signals corresponding to the plurality of audio sources and a second residual signal; and adding the residual signals to the audio sources, respectively.

2. The method of claim 1, wherein the first residual signal is an audio signal which is common to at least two of the plurality of audio sources.

3. The method of claim 1, wherein the first separation operation and the second separation operation are performed by using a Nonnegative Matrix Factorization-Expectation Maximization (NMF-EM) method, and wherein the second separation operation uses parameters which are determined based on initial parameters used in the first separation operation and parameters updated by the first separation operation.

4. A method for separating audio sources, the method comprising:

receiving a mixed audio signal;

a first separation operation of separating the input mixed audio signal into a plurality of audio sources and a first residual signal;

a second separation operation of separating the residual signal separated by the first separation operation into residual signals corresponding to the plurality of audio sources and a second residual signal; and adding the residual signals to the audio sources, respectively, wherein the first separation operation and the second separation operation are performed by using a Nonnegative Matrix Factorization-Expectation Maximization (NMF-EM) method, wherein the second separation operation uses parameters which are determined based on initial parameters used in the first separation operation and parameters updated by the first separation operation, and wherein the second separation operation uses parameters which are obtained by giving weightings to the determined parameters.

5. The method of claim 4, wherein the weighting is determined based on an absolute power average of the mixed audio signal and an absolute power average of the first residual signal.

6. An audio system comprising:

an input unit configured to receive a mixed audio signal;

a separation unit configured to separate the input mixed audio signal into a plurality of audio sources and a first residual signal, and separate the first residual signal into residual signals corresponding to the plurality of audio sources and a second residual signal; and an audio source combination unit configured to add the residual signals to the audio sources, respectively.

* * * * *